US010039358B2

(12) United States Patent
Hanson

(10) Patent No.: US 10,039,358 B2
(45) Date of Patent: Aug. 7, 2018

(54) CARRYING BAG FOR HAIRSTYLING TOOLS

(71) Applicant: Kathy Hanson, Salina, KS (US)

(72) Inventor: Kathy Hanson, Salina, KS (US)

( * ) Notice: Subject to any disclaimer, the term of this patent is extended or adjusted under 35 U.S.C. 154(b) by 0 days.

(21) Appl. No.: 14/813,816

(22) Filed: Jul. 30, 2015

(65) Prior Publication Data

US 2016/0095403 A1 Apr. 7, 2016

Related U.S. Application Data

(60) Provisional application No. 62/060,852, filed on Oct. 7, 2014.

(51) Int. Cl.

| | |
|---|---|
| ***A45C 11/24*** | (2006.01) |
| ***A45C 11/20*** | (2006.01) |
| ***A45D 44/18*** | (2006.01) |
| ***A45C 13/02*** | (2006.01) |
| ***A45C 11/00*** | (2006.01) |
| *H01R 25/00* | (2006.01) |

(52) U.S. Cl.

CPC ..... *A45C 11/24* (2013.01); *A45C 11/00* (2013.01); *A45C 13/02* (2013.01); *A45D 44/18* (2013.01); *H01R 25/006* (2013.01)

(58) Field of Classification Search

CPC ..... A45C 11/24; A45C 13/02; A45D 44/18; A45F 3/08

USPC ..... 190/107

See application file for complete search history.

(56) References Cited

U.S. PATENT DOCUMENTS

| | | | | | |
|---|---|---|---|---|---|
| 3,023,867 | A * | 3/1962 | Kotkins | A45C 3/001 | 190/113 |
| 3,994,372 | A * | 11/1976 | Geller | A45C 3/00 | 190/107 |
| 5,501,324 | A * | 3/1996 | Franklin | A45C 3/004 | 190/109 |
| 5,577,819 | A * | 11/1996 | Olsen | A47B 81/00 | 312/209 |
| 5,810,168 | A * | 9/1998 | Eggering | A45C 15/00 | 206/372 |
| 5,917,694 | A * | 6/1999 | Denny | A45D 1/00 | 206/372 |
| 5,924,892 | A * | 7/1999 | Ferracina | H01R 13/72 | 439/501 |
| 6,070,729 | A * | 6/2000 | Barnes | A45C 11/26 | 206/373 |

(Continued)

*Primary Examiner* — Todd E Manahan
*Assistant Examiner* — Jennifer Gill
(74) *Attorney, Agent, or Firm* — Global Intellectual Property Agency, LLC; Jordan Sworen

(57) ABSTRACT

A carrying bag suited for transporting hairstyling products. The carrying bag comprises a housing having a base, sidewalls, a rear wall, an open front, and an open upper end. A flap attached to the base is removably securable over the front and upper portions so as to enclose the interior volume of the housing. The housing may further include one or more handles or shoulder straps. An interior wall extends between opposing sidewalls and defines a front compartment and a rear compartment, wherein the rear compartment can be further subdivided into smaller compartments in which hairstyling products can be stored. The front compartment further includes a power strip having an electrical plug for securement to an electrical outlet and one or more sockets for connection to electrical hairstyling products.

7 Claims, 2 Drawing Sheets

(56) References Cited

U.S. PATENT DOCUMENTS 6,305,388 B1 * 10/2001 Zeller ..... A45D 44/02 132/287
6,334,519 B1 * 1/2002 Tong ..... A45C 3/00 190/107
6,530,475 B1 * 3/2003 Penney ..... G06F 1/1628 190/110
6,808,066 B2 * 10/2004 Bean ..... A45C 11/00 150/165
6,883,654 B2 * 4/2005 Godshaw ..... A45C 7/0054 190/107
6,910,560 B2 * 6/2005 Dulin ..... A45C 3/00 150/112
7,293,635 B2 * 11/2007 Repke ..... A45C 3/06 190/109
7,593,222 B2 * 9/2009 Zbikowski ..... A45C 13/02 190/12 A
7,628,271 B1 * 12/2009 Marton ..... G06F 1/1628 206/305
D732,824 S * 6/2015 Tzortzis ..... D3/288
9,144,281 B2 * 9/2015 Cross ..... A45C 5/14
2003/0130691 A1 * 7/2003 Porrata ..... A61F 5/0118 606/204
2004/0085694 A1 5/2004 Germagian et al.
2004/0108179 A1 * 6/2004 Scicluna ..... A45C 5/06 190/109
2007/0159781 A1 7/2007 Zbikowski
2009/0194445 A1 * 8/2009 Mongan ..... A45C 13/021 206/320
2011/0011761 A1 * 1/2011 Enmon ..... A45C 13/02 206/320
2011/0133572 A1 * 6/2011 Levi ..... A45D 20/14 307/139
2012/0212896 A1 8/2012 Schulz
2012/0212940 A1 8/2012 Leuty
2013/0292014 A1 * 11/2013 Mosee ..... A45C 1/02 150/107
2014/0261533 A1 * 9/2014 Brock ..... A45C 11/008 132/314

* cited by examiner

CARRYING BAG FOR HAIRSTYLING TOOLS

CROSS REFERENCE TO RELATED APPLICATION

This application claims the benefit of U.S. Provisional Application No. 62/060,852 filed on Oct. 7, 2014. The above identified patent application is herein incorporated by reference in its entirety to provide continuity of disclosure.

BACKGROUND OF THE INVENTION

Field of the Invention

The present invention relates to carrying bags. More specifically, the present invention provides a carrying bag for storing hairstyling products having an interior volume divided into one or more compartments in which hairstyling products, such as curling irons, hair straighteners, blow dryers, and the like can be stored. The carrying bag further includes a power strip for providing power to the hairstyling tools.

People commonly use one or more hairstyling tools and products when getting ready for the day. Many hairstyling tools are commonly used including curling irons, hair straighteners, and blow dryers, among others. These devices can be difficult to store and transport in an organized manner. The hairstyling tools have cables that can become tangled, often making it difficult to separate multiple tools. The hairstyling tools are susceptible to damage if they are not stored in an organized manner. Further, many hairstyling tools are hot when used and must be allowed to cool prior to storage. Otherwise, the heat from the hairstyling tool can cause damage to other objects in the area in which the hairstyling tool is stored.

Devices have been disclosed in the prior art that relate to carrying bags and cases. These include devices that have been patented and published in patent application publications. U.S. Published Patent Application Number 2004/0085694, U.S. Published Patent Application Number 2011/0011761, U.S. Published Patent Application Number 2007/0159781, and U.S. Published Patent Application Number 2012/0212896 generally relate to carrying cases for laptops and other electronic devices, wherein the carrying case includes a power source therein. Further, U.S. Published Patent Application Number 2012/0212940 provides a purse or handbag having a light source integrated therein.

These prior art devices have several known drawbacks. Devices in the prior art generally relate to carrying cases for computers and other electronic devices. Such devices are not adapted for transport and storage of hairstyling tools, such as flat irons, curling irons, and hair dryers, among others. Further, such devices fail to provide a housing having a flap removably securable over the front and upper portion thereof for providing access to the interior volume of the carrying bag.

In light of the devices disclosed in the prior art, it is submitted that the present invention substantially diverges in design elements from the prior art and consequently it is clear that there is a need in the art for an improvement to existing carrying bag devices. In this regard the instant invention substantially fulfills these needs.

SUMMARY OF THE INVENTION

In view of the foregoing disadvantages inherent in the known types of carrying bags now present in the prior art, the present invention provides a new carrying bag for hairstyling tools wherein the same can be utilized for providing convenience for the user when storing and transporting one or more hairstyling products.

It is therefore an object of the present invention to provide a new and improved carrying bag device that has all of the advantages of the prior art and none of the disadvantages.

It is another object of the present invention to provide a carrying bag device for hairstyling products having a housing with an interior volume divided into one or more compartments adapted to store hairstyling tools therein.

Another object of the present invention is to provide a carrying bag for hairstyling products comprising an integrated power strip for providing power to one or more hairstyling tools.

Yet another object of the present invention is to provide a carrying bag for hairstyling tools having an opening with a panel thereover adapted to allow an electrical cable from a power strip within the carrying bag to extend therethrough.

A further object of the present invention is to provide a carrying bag for hairstyling tools having a heat resistant lining for preventing heat damage from the one or more hairstyling tools stored therein.

Another object of the present invention is to provide a carrying bag for hairstyling tools that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
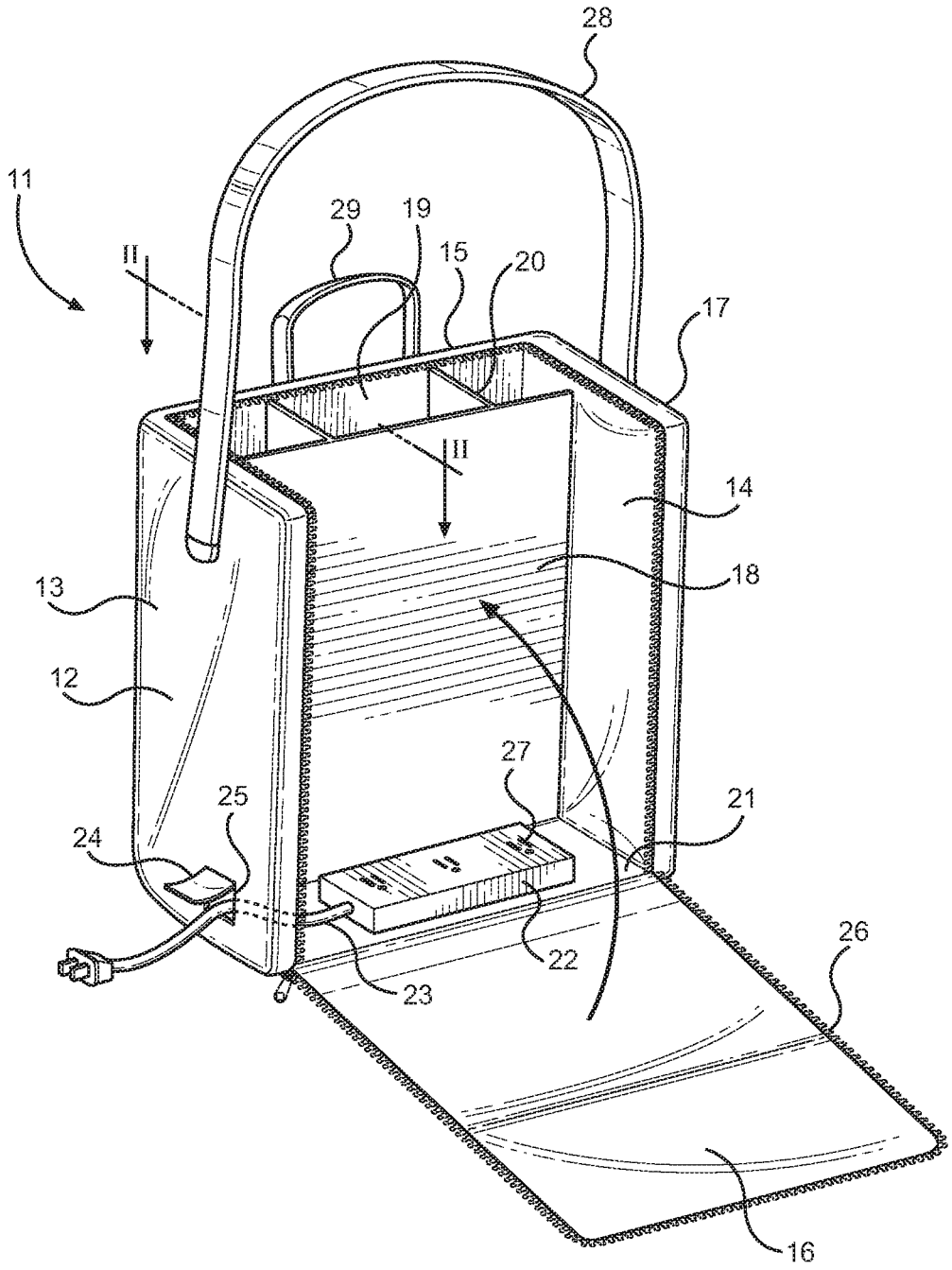
FIG. 1A shows a perspective view of an embodiment of the carrying bag in an open configuration.

Reference is made herein to the attached drawings. Like reference numerals are used throughout the drawings to depict like or similar elements of the carrying bag of the present invention. For the purposes of presenting a brief and clear description of the present invention, the preferred embodiment will be discussed as used for storing and transporting one or more hairstyling tools or other products. The figures are intended for representative purposes only and should not be considered to be limiting in any respect.

Figure 1B:
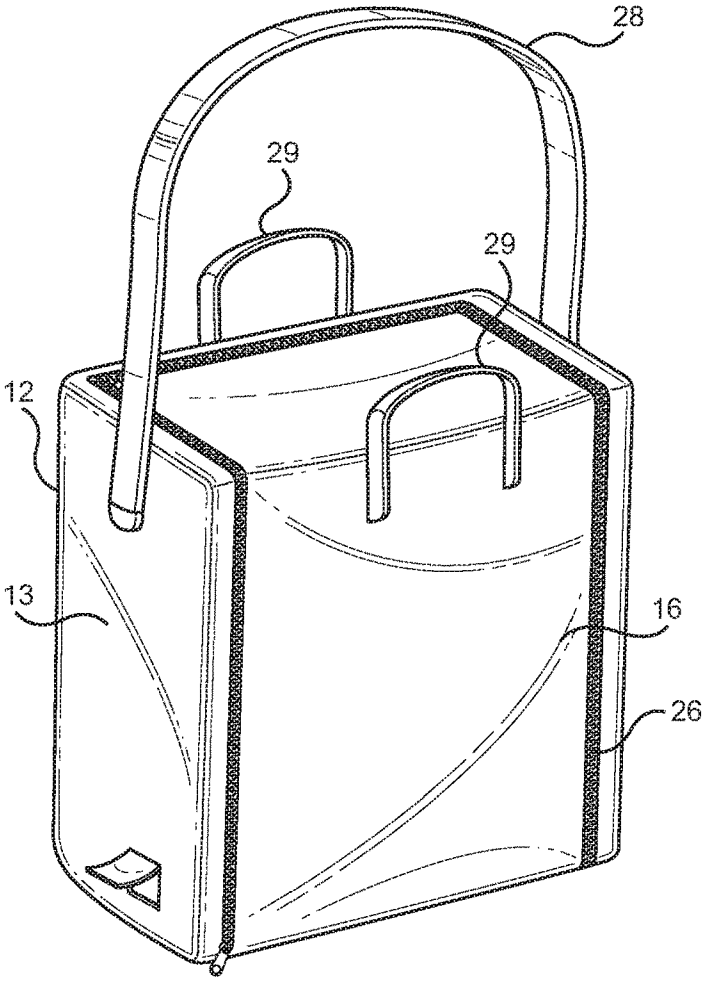
FIG. 1B shows a perspective view of an embodiment of the carrying bag in a closed configuration.

Referring now to FIGS. 1A and 1B, there are shown perspective views of the carrying bag in an open and closed configuration, respectively. The carrying bag 11 comprises a housing 12 having a base 21, a pair of sidewalls 13, 14, and a rear wall 15, defining an interior volume, wherein the front and upper portions of the housing 12 are open. A flap 16 is secured to the base 21 and is adapted to cover the open front and open upper portions of the housing 12. The flap 16 can be removably positioned so as to cover or provide access to the interior volume of the housing 12. The perimeter of the flap 16 includes a fastener 26, such as a zipper, thereon adapted to be secured to a corresponding fastener along the housing 12. The housing 12 is preferably substantially rectangular in configuration and is composed of a flexible and lightweight material. The housing 12 is composed of a heat resistant material for preventing hot or warm items stored therein from damaging the housing 12 or other tools stored within the housing 12.

The interior volume of the housing 12 is preferably divided into one or more compartments via one or more interior walls 18 and dividing walls 20. In the illustrated embodiment, the housing 12 comprises an interior wall 18 that extends between the opposing sidewalls 13, 14 so as to define a rear compartment and a front compartment. The interior wall 18 is preferably substantially parallel to the rear wall 15 of the housing 12. Further, the rear compartment is divided into smaller compartments 19 suited for storage of a single hairstyling tool therein. The smaller compartments 19 are formed via one or more dividing walls 20 extending between the interior wall 18 and the rear wall 15 of the housing 12. The dividing walls 20 are preferably perpendicular to the rear wall 15 and interior wall 18 so as to form substantially rectangular or square compartments 19. The front compartment is preferably used for storage of larger hairstyling tools such as blow dryers, and can be used for storage of additional accessories and hairstyling products.

The front compartment includes a power strip 22 therein having one or more electrical sockets 27 and an electrical cable 23 extending outward therefrom and adapted to be connected to an electrical outlet in order to provide power to the electrical sockets 27. The power strip 22 is preferably arranged along the base 21 of the front compartment. The power strip 22 can be used to provide the user with convenient access to electrical sockets 17 for powering the hairstyling tools stored within the housing 12. The electrical cable 23 is adapted to be extended outward from the interior volume of the housing through an opening 25 on a sidewall 13 of the housing 12. The opening 25 includes a panel 24 movably positioned thereon for covering the opening 25 when the electrical cable 23 is not extended therethrough, such as when the user is transporting the carrying bag 11.

The housing 12 further includes one or more handles or carrying straps for allowing the user to more easily transport the carrying bag 11. In some embodiments, the housing 12 includes a shoulder strap 28 having a first end and a second end, wherein a first end is secured to a first sidewall 13 and the second end is secured to a second sidewall 14 on the opposing side of the housing 12. In some embodiments, the housing 12 can include a first handle 29 positioned on the rear wall of the housing 12, and a second handle 29 positioned on the flap 16 of the housing 12, wherein the flap 16 removably covers the front and upper portion of the housing 12. The handles 29 are shown as having a U-shape configuration, but may alternatively have other configurations.

Figure 2:
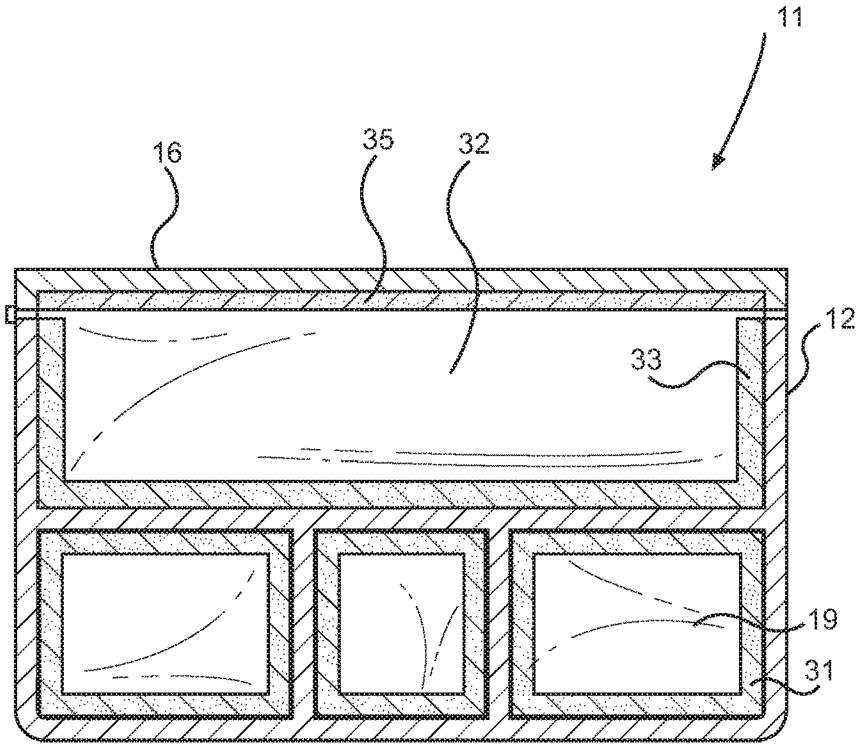
FIG. 2 shows a cross sectional view of the compartments of the carrying bag taken along line II of FIG. 1A.

Referring now to FIG. 2, there is shown a cross sectional view of the compartments of the carrying bag taken along line II of FIG. 1A. The interior volume of the housing 12 is divided into a front compartment 32 and a rear compartment, which is further subdivided into smaller compartments 19. Each of the front compartments 32 and smaller compartments 19 includes a heat resistant lining 31 and 33 for protecting the housing 12 from damage from hot or warm hairstyling tools placed within the compartments. The flap 16 may also include a heat resistant lining 35. The exterior of the housing 12 and the interior wall and dividing walls can be composed of any suitable material that is durable and lightweight, such as leather or nylon, among others. Alternatively, in some embodiments, the entirety of the housing 12 is composed of a heat resistant material.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrying bag for hairstyling products, comprising:

a housing having a base, a pair of sidewalls, a rear wall, an open front portion, and an open upper portion, defining an interior volume;

a lip extending inward along an entire perimeter of said open front portion and said open upper portion, said lip having an interior edge extending vertically from the base towards the open upper end;

the open front portion disposed on a vertical plane extending laterally between the interior edge and vertically between the base and open upper portion;

the open upper portion disposed on a horizontal plane perpendicular to the open front portion;

a zipper configured to continuously secure a flap to said lip in a closed configuration;

said flap being a flexible panel forming a front wall adapted to cover said open front wall and an upper wall adapted to removably cover said open upper wall in the closed configuration;

one or more compartments within said interior volume configured to store hairstyling tools therein;

a power strip having one or more electrical sockets thereon, wherein said power strip is disposed within said interior volume of said housing;

wherein said interior volume is divided into the one or more compartments by an interior wall, the interior wall is attached to the base and to each of the pair of sidewalls such that the interior wall extends therebetween, defining a front compartment and a rear compartment of the one or more compartments;

wherein both the front compartment and the rear compartment are accessible via removal of the flap from the housing; and wherein said rear compartment is subdivided into a plurality of sub-compartments by a plurality of dividing walls that directly extend from said interior wall to said rear wall wherein said housing further comprises an opening through which an electrical cable of the power strip extends, wherein said opening is covered by a second flap secured to said housing; and wherein the front compartment and the rear compartment have equal volume.

2. The carrying bag of claim 1, wherein said housing is substantially rectangular in configuration.

3. The carrying bag of claim 1, wherein said rear compartment and said front compartment comprise a heat resistant lining.

4. The carrying bag of claim 1, wherein said flap comprises a heat resistant lining on an interior surface thereof.

5. The carrying bag of claim 1, wherein said housing further comprises a shoulder strap having a first end and a second end, wherein said first end is secured to a first sidewall of said pair of sidewalls, and wherein said second end is secured to a second sidewall of said pair of sidewalls.

6. The carrying bag of claim 1, wherein said housing comprises one or more handles thereon.

7. The carrying bag of claim 1, wherein each of the plurality of dividing walls are parallel with each other, and perpendicular to the interior wall, wherein each of the plurality of sub-compartments extend along a vertical axis.

* * * * *